US009359700B2

(12) United States Patent
Burkert et al.

(10) Patent No.: US 9,359,700 B2
(45) Date of Patent: Jun. 7, 2016

(54) WEFT INSERTION SYSTEM AND WEAVING MACHINE COMPRISING SUCH A SYSTEM

(71) Applicant: SCHONHERR Textilmaschinenbau GmbH, Chemnitz (DE)

(72) Inventors: Martin Burkert, Bayreuth (DE); Carl-Guenther Cordes, Bayreuth (DE)

(73) Assignee: SCHONHERR Textilmaschinenbau GmbH, Chemnitz (DE)

( * ) Notice: Subject to any disclaimer, the term of this patent is extended or adjusted under 35 U.S.C. 154(b) by 0 days.

(21) Appl. No.: 14/323,162

(22) Filed: Jul. 3, 2014

(65) Prior Publication Data

US 2015/0027583 A1 Jan. 29, 2015

(30) Foreign Application Priority Data

Jul. 24, 2013 (EP) ..... 13306071

(51) Int. Cl.

| | |
|---|---|
| ***D03D 47/27*** | (2006.01) |
| ***D03D 47/23*** | (2006.01) |
| ***D03D 47/14*** | (2006.01) |
| ***D03D 47/16*** | (2006.01) |
| ***D03D 47/18*** | (2006.01) |
| ***D03D 49/62*** | (2006.01) |
| *D03D 49/50* | (2006.01) |

(52) U.S. Cl.

CPC ..... *D03D 47/277* (2013.01); *D03D 47/14* (2013.01); *D03D 47/16* (2013.01); *D03D 47/18* (2013.01); *D03D 47/23* (2013.01); *D03D 47/233* (2013.01); *D03D 47/236* (2013.01); *D03D 47/271* (2013.01); *D03D 47/272* (2013.01); *D03D 47/273* (2013.01); *D03D 49/62* (2013.01)

(58) Field of Classification Search

CPC ..... D03D 47/14; D03D 47/16; D03D 47/18; D03D 47/23; D03D 47/233; D03D 47/236; D03D 47/271; D03D 47/272; D03D 47/273; D03D 47/277; D03D 49/62; D03D 49/44

See application file for complete search history.

(56) References Cited

U.S. PATENT DOCUMENTS

| | | | | |
|---|---|---|---|---|
| 3,902,535 | A * | 9/1975 | Jusko et al. | 139/134 |
| 4,126,159 | A * | 11/1978 | Vercaemert | 139/449 |
| 8,941,343 | B2 * | 1/2015 | Lipp et al. | 318/434 |
| 2012/0319632 | A1 * | 12/2012 | Lipp et al. | 318/400.21 |
| 2014/0253170 | A1 * | 9/2014 | Lipp et al. | 324/762.01 |

FOREIGN PATENT DOCUMENTS

| | | | |
|---|---|---|---|
| DE | 2643626 | A1 | 4/1977 |
| DE | 102006030648 | B3 | 1/2008 |

(Continued)

*Primary Examiner* — Bobby Muromoto, Jr.

(74) *Attorney, Agent, or Firm* — Dowell & Dowell, P.C.

(57) ABSTRACT

A weft insertion system includes at least one rapier provided with weft yarn clamping means for drawing a weft and a reed provided with dents made of a magnetic material, and wherein the rapier has at least one permanent magnet whose direction of polarization extends along a direction which is perpendicular to a longitudinal axis of the reed dents when the reed is in a back position and to a translation direction of the rapier, the at least one permanent magnet exerts an attractive magnetic effort (E, E') between the rapier and the dents of the reed and the reed has a variable magnetic permeability along its longitudinal axis, and the rapier has a lateral face oriented towards the reed and the at least one permanent magnet has a direction of polarization perpendicular to the direction of travel of the rapier and secant with the lateral face.

11 Claims, 6 Drawing Sheets

(56) References Cited

FOREIGN PATENT DOCUMENTS

| | | | |
|---|---|---|---|
| EP | 0233141 | A1 | 8/1987 |
| EP | 0759484 | A1 | 2/1997 |
| EP | 1777328 | A1 | 4/2007 |
| WO | 2008052369 | A1 | 5/2008 |

* cited by examiner

WEFT INSERTION SYSTEM AND WEAVING MACHINE COMPRISING SUCH A SYSTEM

TECHNICAL FIELD OF THE INVENTION

This invention relates to a weft insertion system for a weaving machine. This invention also relates to a weaving machine, such as a loom, which includes such a weft insertion system.

BACKGROUND OF THE INVENTION

Rapier looms are widely used nowadays because the weft yarns are efficiently guided within the shed, thanks to a bringer rapier head clamp and a taker rapier head clamp which cooperate in a central zone of the shed in order to transfer a weft yarn from the bringer rapier to the taker rapier. Rapiers are formed of a head, provided with weft yarn clamping means, and a driving member, such as a rod or a belt, which moves the head within the shed, during weaving of a fabric. The driving member usually cooperates with a pinion located on one side of the fabric. Once a pick, the shed is opened and a reed is moved in a backward position, so that the shed and the reed together define a kind of a corridor into which the two rapiers travel up to the middle of the fabric.

In order to allow an efficient transfer of the weft yarn from the bringer rapier to the taker rapier, the rapiers must exactly meet in the middle of the shed. The rapier heads can be considered to be guided by the warp yarns since the transverse section of the corridor is close to the transverse shape of the rapier heads. However, frictions on the warp yarns are damageable and may cut some warp yarns and lead to faults in the fabric. If the rapier heads are not efficiently guided by the warp yarns, they tend to "shake" within the shed because of the dynamic deformation of the driving member, so that their respective positions, when they arrive at the take-over region, are uncertain.

DE-A-10 2006 030 628 discloses a reed with dents made of a magnetic material.

EP-A-1 479 808 discloses a rapier device for a weaving machine where one rapier is provided with a permanent magnet in order to generate, in the take-over zone, a magnetic attractive force between the rapiers. This magnetic attractive force is active only in take-over zone, which does not prevent the rapiers to shake within the shed on their way towards this zone, to the point that they can be offset from each other when they reach this zone. In other words, the magnet may not be sufficient to guarantee that the rapier heads are correctly aligned in the take-over zone.

These inconvenients become more and more critical on large weaving machines where fabrics are woven on a width larger than four meters, e.g. five meters.

Similar inconvenients occur with weft yarns insertion systems which include only one rapier, either a bringer rapier or a taker rapier, which must be prevented from shaking when it travels within the shed.

SUMMARY OF THE INVENTION

This invention aims at solving these problems with a new weft insertion system where the position of the rapier heads is well defined and guaranteed, so that take-over of the weft yarn from the bringer rapier head to the taker rapier head is facilitated.

To this end, the invention concerns a weft insertion system for a weaving machine, said system including at least one rapier provided with weft yarn clamping means for drawing a weft yarn, characterized in that the weft insertion system also includes a reed provided with dents made of a magnetic material, and in that the rapier is equipped with magnetic means for exerting an attractive magnetic effort between this rapier and the dents of the reed.

Thanks to the invention, the reed, which belongs to the weft insertion system, forms a guide which defines the path of the rapier thanks to the attractive magnetic effort. This determines the position of this rapier's head within the corridor formed by the shed and the reed in its back position. In other words, the magnetic effort due to the interaction between the magnetic means of the rapier and the dents of the reed guarantees that the rapier follows a straight path within the shed.

According to further aspects of the invention, which are advantageous but not compulsory, the system of the invention might incorporate one or several of the following features, taken in any technically admissible configuration:

- The at least one rapier includes a rapier head which comprises the weft yarn clamping means and a driving member for driving this head in translation and the magnetic means are located in a connection zone between the rapier head and the driving member.
- The magnetic means include at least one permanent magnet whose direction of polarization extends along a direction which is perpendicular or substantially perpendicular to a longitudinal axis of the reed dents when the reed is in a back position and to a translation direction of the rapier.
- The at least one rapier is provided with a glider, which glides on the dents of the reed during a back and forth motion of the rapier, and the magnetic means are fitted within the glider.
- The glider is provided with wear indication means for protecting the magnetic means from abrasion by contact with the dents of the reed.
- Each permanent magnet is received within a blind hole arranged within the glider with its opening oriented opposite to a gliding surface of the glider, which glides on the dents of the reed during a back and forth motion of the rapier.
- The wear indication means include a stick of a colour different from the colour of the glider, this stick being installed in a second blind hole, arranged within the glider with its opening oriented opposite to the gliding surface, and the thickness of a bottom wall of the second blind hole is smaller than the thickness of the bottom wall of a blind hole which accommodates a permanent magnet.
- The magnetic means include several permanent magnets with parallel directions of polarization and the respective polarities of the magnets are oriented in the same direction.
- The magnetic means include several permanent magnets with parallel directions of polarization and at least two permanent magnets are coupled via a magnetic plate, with their respective polarities oriented in opposite directions.
- Two coupled permanent magnets are adjacent in a direction parallel to the reed dents.
- The weft insertion system includes a bringer rapier provided with first weft yarn clamping means for drawing a weft yarn, a taker rapier provided with second weft yarn clamping means for taking up and drawing a weft yarn, whereas the bringer rapier and the taker rapier are provided with magnetic means for exerting the magnetic effort between each rapier and the dents of the reed.

The magnetic permeability of the reed varies along its longitudinal axis. Thanks to this feature, the magnetic effort between the magnetic means of the rapier and the reed can vary along the length of the reed. In particular, this effort can be made stronger in the take-over zone of a weaving machine.

The reed includes first dents with a first magnetic permeability and second dents with a second magnetic permeability, the second magnetic permeability having a value strictly higher than the first magnetic permeability.

The reed can be divided, along its longitudinal axis, in at least two zones, with a first zone where its dents are mainly or totally formed of first dents and the second zone where its dents are mainly or totally formed of second dents, whereas the second zone includes a portion of the reed located opposite the weft yarn clamping means of the rapiers when the taker rapier takes the weft yarn over from the bringer rapier. Thanks to this aspect of the invention, the highest magnetic effort applies when the rapier heads are in the take-over zone of the shed.

Finally, the invention relates to a weaving machine, such as a loom, comprising, amongst others, a weft insertion system as mentioned here-above. Such a weaving machine is more reliable and can work at higher speeds and on a larger width as known weaving machines.

BRIEF DESCRIPTION OF THE DRAWINGS

The invention will be better understood on the basis of the following description which is given in correspondence with the appended figures and as an illustrative example, without restricting the object of the invention. In the annexed figures.

DETAILED DESCRIPTION OF SOME EMBODIMENTS

The loom or weaving machine WM partially represented on FIGS. 1 to 6 is a weaving machine where warp yarns circulate in the direction of arrow A1, across a reed 2 which includes several dents 22 spread over a longitudinal axis X2 of reed 2. The weaving width of loom WM is 5 meters. Reed 2 is more than 5 meters long.

Figure 3:
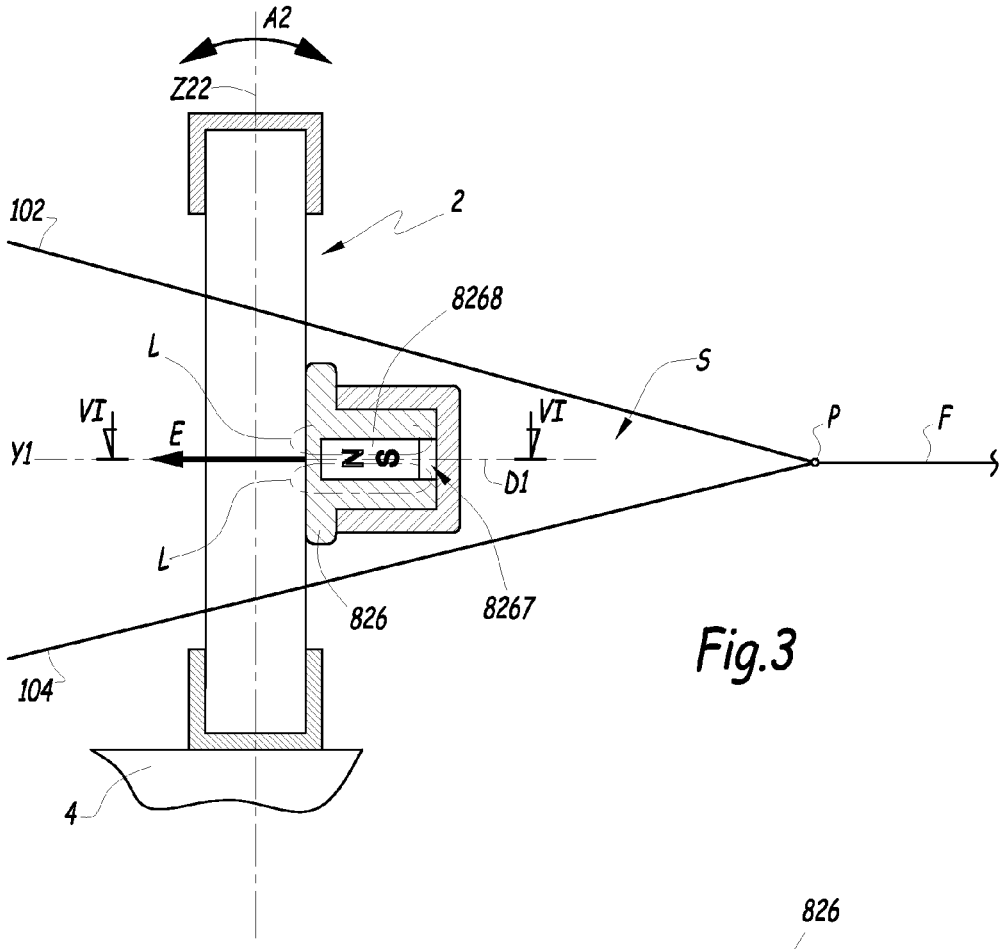
FIG. 3 is a vertical sectional view along line III-III on FIG. 2.

As shown on FIG. 3, reed 2 is mounted on a sley 4 which drives reed 2 in a reciprocal movement shown by arrow A2. This enables to alternatively bring reed 2 from a back position represented on the figures to a front position where it beats the fabric F at the level of the last woven portion of the fabric represented by a beating point P on FIG. 3.

Each dent 22 of reed 2 is made of a magnetic material, such as carbon steel, and extends along a longitudinal axis Z22 which is vertical when reed 2 is in its back position represented on FIG. 3. Actually, in the back position of reed 2, axis Z22 of dents 22 can be globally vertical, that is inclined with respect to the vertical by an angle up to 30°.

The warp yarns used in loom WM are moved by a non represented shedding device in order to take one of two positions respectively represented by upper weft yarns 102 and lower weft yarn 104 on FIG. 3. When the weft yarns are in these positions, they define together a shed S which extends between reed 2 and beating point P and where two rapiers 6 and 8 can be introduced, along directions substantially parallel to axis X2.

Rapier 6 is a bringer rapier and it includes a rapier head 62 and a rapier rod 64 which is designed to interact with a pinion 12 driven by a non represented electric motor or rapier gearbox. The rotation of pinion 12 around its central axis is represented by arrow A3 and allows to move rapier 6 along a longitudinal path centred on an axis X6, while a guide member 13 defines the translation direction of rapier 6 along axis X6.

Taker rapier 8 is driven by a non represented rotating pinion similar to item 12 and centered on its path by a non represented guide member similar to item 13. Rapier 8 includes a rapier head 82 and a rapier rod 84 movable along an axis X8.

Rapiers 6 and 8 can also be respectively called donor rapier and gripper rapier.

Instead of a rod, rapiers 6 and 8 can use, as a driving element for their respective heads 62 and 82, a flexible member such as a timing belt.

A weft yarn presentation unit 14 is located next to pinion 12 and a weft yarn 202 wound on this weft presentation unit 14 is attached to rapier head 62.

Figure 1:
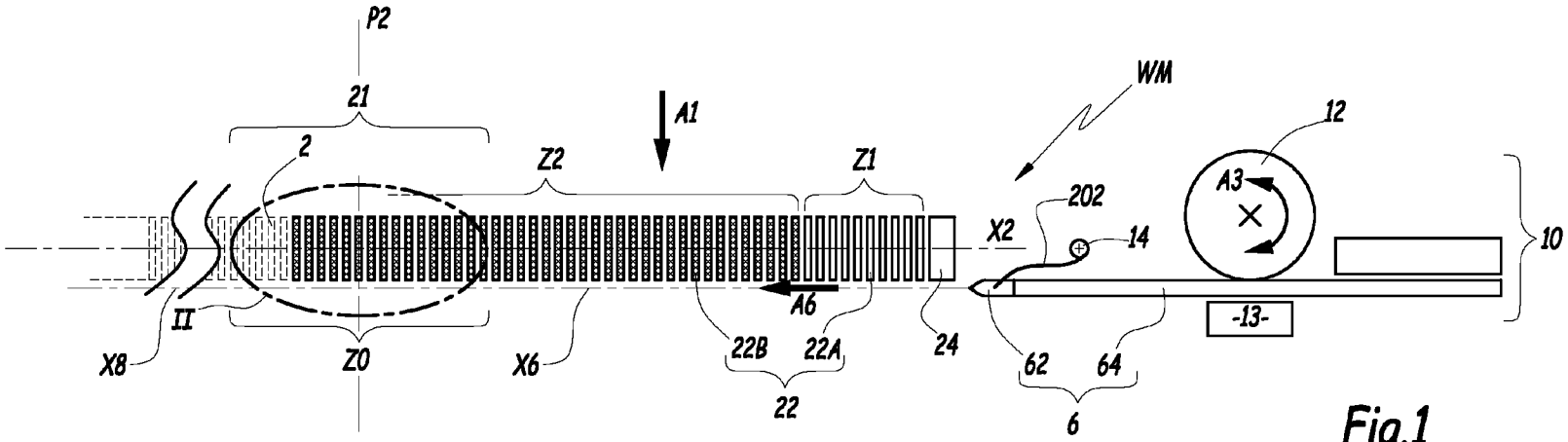
FIG. 1 is a partial top view of a weaving machine according to the invention.

Rapier head 62 is provided with clamping means 622, which enables rapier 6 to draw weft yarn 202 from the weft yarn presentation unit 14 when rapier 6 moves towards rapier 8 within shed S, in the direction of arrow A6 on FIG. 1.

On the other hand, rapier head 82 is provided with clamping means 822, which allows rapier 8 to take up weft yarn 202 when rapier heads 62 and 82 are in a take-over zone ZO of loom WM which is defined in shed S, opposite a median region 21 of reed 2, along its longitudinal axis X2.

Figure 2:
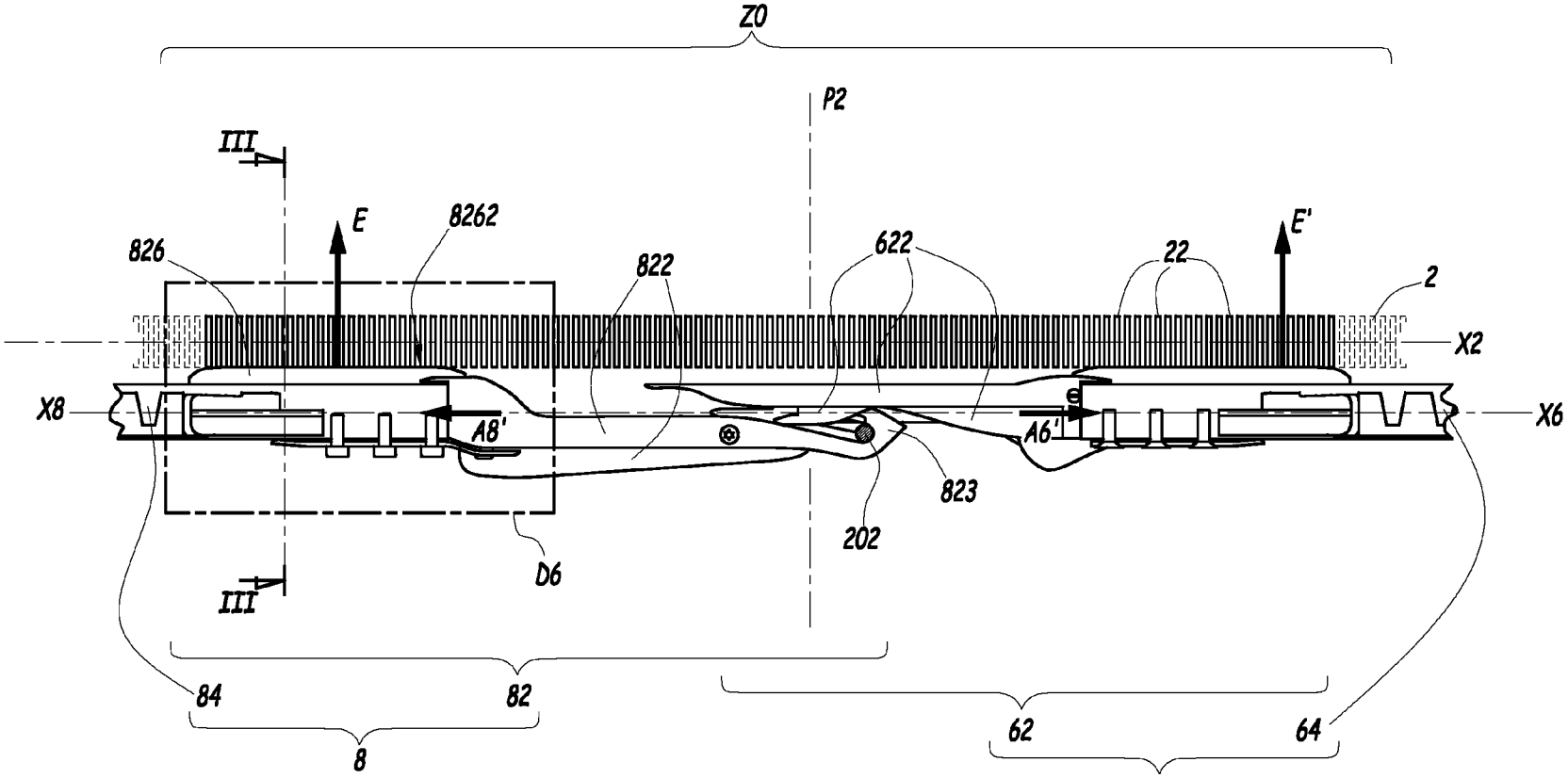
FIG. 2 is an enlarged view corresponding to detail II on FIG. 1, when two rapiers of the weaving machine are in a take-over configuration of a weft yarn.

As known in the art and shown on FIG. 2, in the take-over zone ZO, rapier heads 62 and 82 converge and overlap, so that the presented weft yarn 202 goes further to a hook 823 of rapier head 82, which opens and enters the clamping means 822. When the rapiers 6 and 8 start to go backwards, that is away from each other in the direction of arrows A6' and A8' on FIG. 2, the weft yarn 202 is caught by hook 823 and clamped by clamping means 822. After this, and when the separation movement of the rapier heads goes on in the direction of arrows A6' and A8', the taker rapier head 82 extracts the weft yarn 202 form the clamping means 622 of the bringer rapier head.

Figure 4:
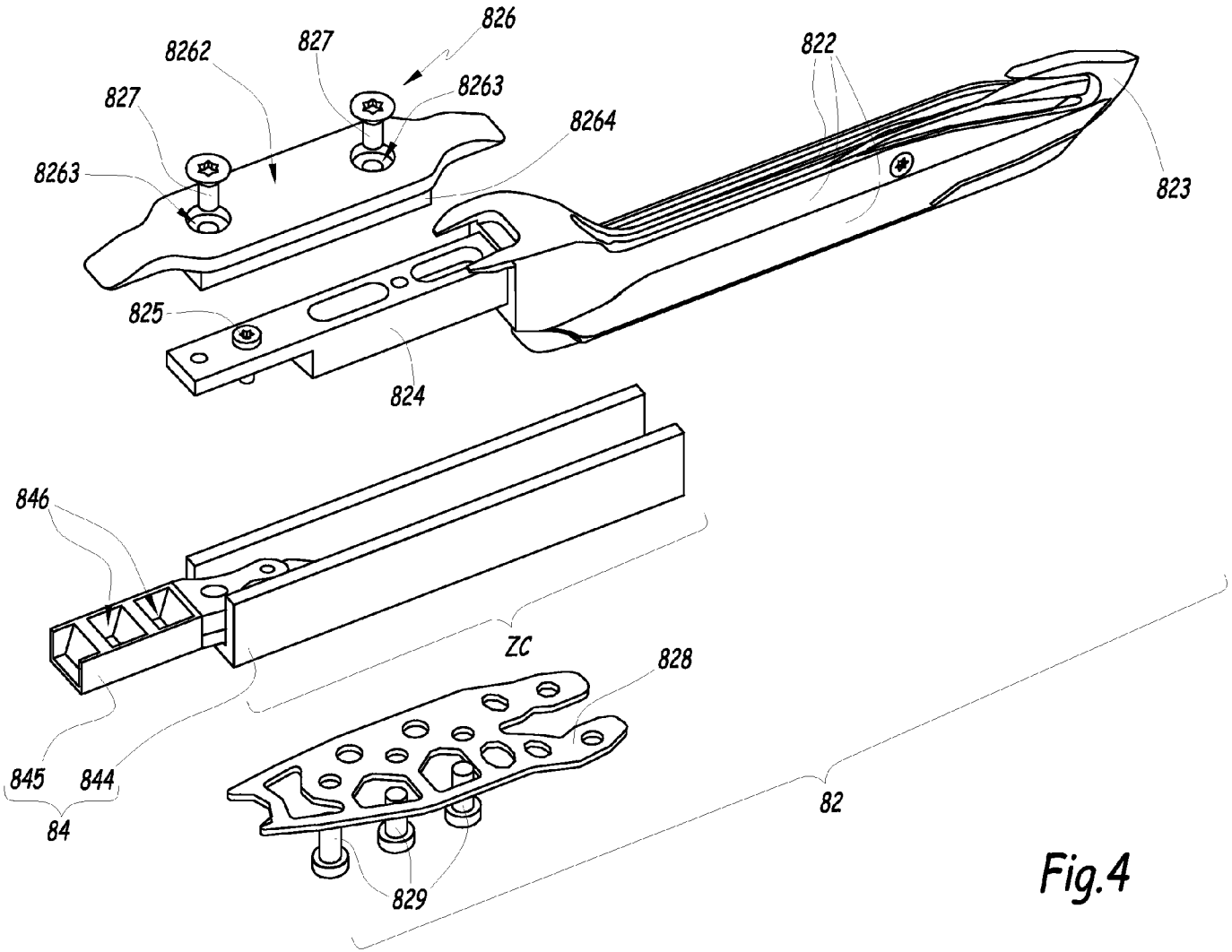
FIG. 4 is a partial exploded perspective view of a rapier according to the invention, which belongs to the system represented on FIGS. 1 to 3.

A shown on FIG. 4, head 82 includes a stem 824 which is received within a U shaped profile 844 made of a composite material including carbon fibers. Profile 844 forms the end of rod 84. On its remaining portion, rod 84 is formed by a rigid rack 845 provided with recesses 846 designed to interact with the teeth of the non represented driving pinion of taker rapier 8.

Rapier head 82 also includes a glider 826 which defines a flat gliding surface 8262 adapted to glide against the teeth 22 of reed 2 when rapier 8 moves along its path centred on axis X8 which is parallel to axis X2.

Glider 826 is made of a synthetic material, such as PEEK, which is chosen for its low friction coefficient with the material of dents 22 and for its high resistance to wear against the dents.

When rapier 8 is assembled, glider 826 is partially received within profile 844.

A reinforcing back plate 828 also belongs to rapier head 82 and it is mounted on U shape profile 844 via several bolts 829, on the side of U shape profile 844 opposite to its internal volume.

Stem 824 is immobilized within U shape profile 844 by a bolt 825 and glider 826 is immobilized onto stem 824 by two bolts 827 whose heads are receive within counterbores 8263 opening on surface 8262. Thus bolts 827 do not protrude externally of glider 826 with respect to surface 8262.

Figure 5:
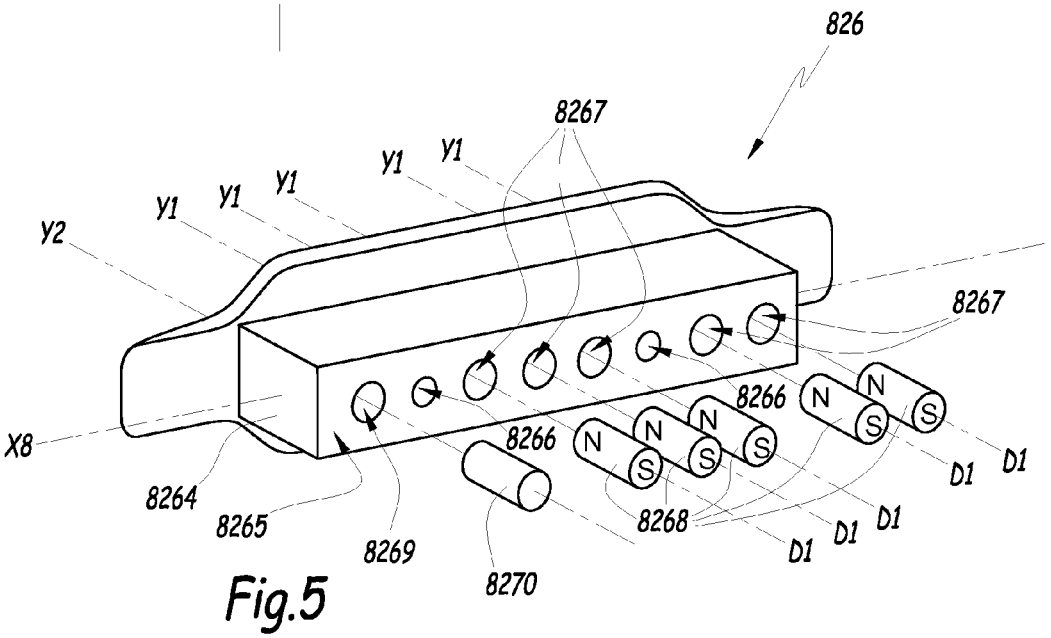
FIG. 5 is an exploded perspective view of a glider belonging to the rapier of FIG. 4.

As shown on FIG. 5 where glider 6 is seen from a different angle as on FIG. 4, this glider is provided with a back portion or heel 8264 which is supposed to be introduced into the inside volume of profile 844 and which is provided with different holes, having each an outlet on a back surface 8265 of glider 826 which is turned in the opposite direction with respect to gliding surface 8262.

Stem 824, heel 8264 and U shape profile 844 together define a connection zone ZC between head 82 and rod 84 where these two elements overlap.

Two holes 8266 extend all the way through glider 826, from counterbores 8263 to surface 8265, for the passage of bolts 827.

Five blind holes 8267 extend from surface 8265 towards surface 8262, with the same geometry, and a correspondingly shaped permanent magnet 8268 is introduced within each one of these blind holes. Alternatively, the number of holes 8267 and permanent magnets 8268 can be different from five.

D1 denotes the direction of polarity of a permanent magnet 8268. Once such a magnet is introduced and glued within a blind hole 8267, its direction D1 is centred onto a central axis Y1 of this blind hole, this axis being perpendicular to axis X8 and secant with gliding surface 8262. Actually, axes Y1 of the respective blind holes 8267 are perpendicular to surface 8262 which is flat and lies against dents 22 in the configuration of FIGS. 2, 3 and 6. Thus, in this configuration, the respective directions of polarization D1 of permanent magnets 8268 are perpendicular to axes X8 and Z22.

Alternatively, axis Y1 and directions D1 can be non perpendicular to axis Z22. In other words, in the plane of FIG. 3, axis Y1 and direction D1 can be non horizontal, provided that they intersect dents 22.

Glider 826 also includes a sixth blind hole 8269 which extends from back surface 8265 along an axis Y2 parallel to axes Y1 of the other blind holes 8267.

A colour stick 8270 is introduced and glued within blind hole 8269 and the colour of this stick is chosen clearly different from the colour of the synthetic material which constitutes glider 826. For instance, stick 8270 can be red when glider 826 is white.

8271 denotes the bottom wall of a blind hole 8267, that is the wall which separates this blind hole from gliding surface 8262. T1 denotes the thickness of this bottom wall. 8272 denotes the bottom wall of blind hole 8269, which separates blind hole 8269 from gliding surface 8262. T2 denotes the thickness of this bottom wall. Thicknesses T1 and T2 are respectively measured perpendicularly to axes Y1 and Y2. Thickness T2 is chosen strictly smaller than thickness T1. For instance, thickness T1 might be equal to 1.5 mm, whereas thickness T2 equals 1 mm.

Figure 6:
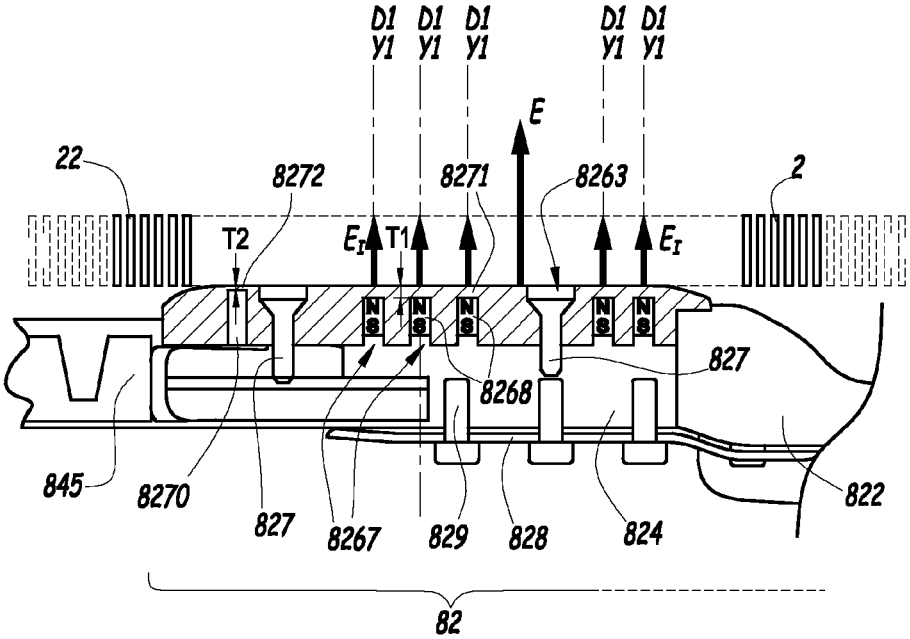
FIG. 6 is a partial cut view, corresponding to detail D6 on FIG. 2, along line VI-VI on FIG. 3.

Thicknesses T1 and T2 are visible on FIG. 6 where, for the sake of clarity, hatchings are used only for glider 826, even if some other parts of rapier 8 and reed 2 are cut in the plane of the figures.

Because of the difference between thicknesses T1 and T2, if surface 8262 is worn out due to its successive contacts with the edges of the dents 22, then colour stick 8270 becomes apparent when bottom wall 8272 has been destroyed before magnets 8268 come into contact with dents 22 since bottom walls 8271 still isolate magnets 8268 from dents 22. Thus, stick 8270 forms a wear indication means which protects magnets 8268 from abrasion by contact with the edges of dents 22, provided that the operator of loom WM periodically checks the quality of surface 8262, in order to detect when stick 8270 becomes apparent through surface 8262.

When they are installed within respective blind holes 8267 and when glider 826 is mounted within rapier head 82, permanent magnets 8268 each exert an individual magnetic effort $E_1$ which pushes glider 826, and actually the whole of head 82, towards dents 22 of reed 2. These individual efforts $E_1$ result in a global attractive magnetic effort represented by arrow E on the figures, this effort being distributed along axis X8 due to the repartition of magnets 8268 within blind holes 8267 along this axis.

Permanent magnets 8268 can be made from neodymium and their polarities are oriented in the same directions. In other words, the orientation of their North poles N and South poles S along their respective directions of polarization D1 is the same for all permanent magnets 8268.

The dimensions and number of permanent magnets 8268 can be chosen in order to have a global attractive magnetic effort E which ranges from 3 to 6 N.

Due to the wear of gliding surface 8262 because of the back and forth movement of rapier head 82, the thickness of bottom walls 8271 decreases, which implies that the attractive magnetic effort E of the invention increases along the life time of magnetic head 82.

As explained here-above, the weft insertion system 10 of the invention, which includes items 2, 6, 8, 12, 13 and 14 and items corresponding to items 12 and 13 for rapier 8, benefits from the fact that the reed 2 belongs to this system, insofar as the magnetic properties of its dents 22 are used to close the magnetic lines L generated by magnets 8268, as shown on FIG. 3. The magnitude of the attractive magnetic effort E exerted between rapier head 82 and reed 2 also depends on the magnetic permeability of the dents. The higher this permeability, the stronger this effort.

In practice, rapier head 62 is also provided with magnetic coupling means similar to magnets 8268 and with a glider similar to glider 826. Thus, an attractive magnetic effort E' is also exerted between rapier head 62 and reed 2.

One can take into account the fact that the attractive magnetic efforts between rapiers 6 and 8 and dents 22 of reed 2 have to be intense in the central take-over region ZO of the shed S, where the two rapier heads 62 and 82 must be precisely aligned with each other. On the contrary, close to the two ends of the reed, some freedom can be left to the rapier heads, in order to adapt their path to the dynamic stresses exerted on the rods 64 and 84. Thus, the magnetic permeability of reed 2 can vary along its longitudinal axis X2.

As shown on FIG. 1 only, for the first embodiment of the invention, a first zone Z1 can be defined within reed 2, next to a first end 24 of this reed, whereas a second zone Z2 is defined between zone Z1 and the centre of reed 2.

In the first zone Z1, dents 22 are of a first type 22A represented by a white rectangle. Dents 22A are made in a magnetic material with a relative magnetic permeability $\mu_{rA}$ of 1 to 10, for instance stainless steel. In the second zone Z2, dents 22 are of a second type 22B represented with a rectangle with hatchings and made in a second material with a relative magnetic permeability $\mu_{rB}$ of 200 to over 1000, for instance martensitic carbon steel. Thus, the magnetic permeability of reed 2 in zone Z1 is smaller than its magnetic permeability in zone Z2. Under such circumstances, the magnetic effort E' exerted between rapier head 62 and reed 2 increases from a relative low value when rapier head 62 is in front of zone Z1 to a relatively high value on rapier head 62 is in front of zone Z2, which includes the central portion 21 of reed 2 aligned with take-over zone ZO in the direction of arrow A1.

The same applies for rapier head 82, as reed 2 is symmetrical with respect to a median plane P2.

According to an alternative embodiment of the invention which is not represented, more than two types of dents 22 can be used, on the basis of more than two different materials, in order to define more than two zones along axis X2.

Figure 9:
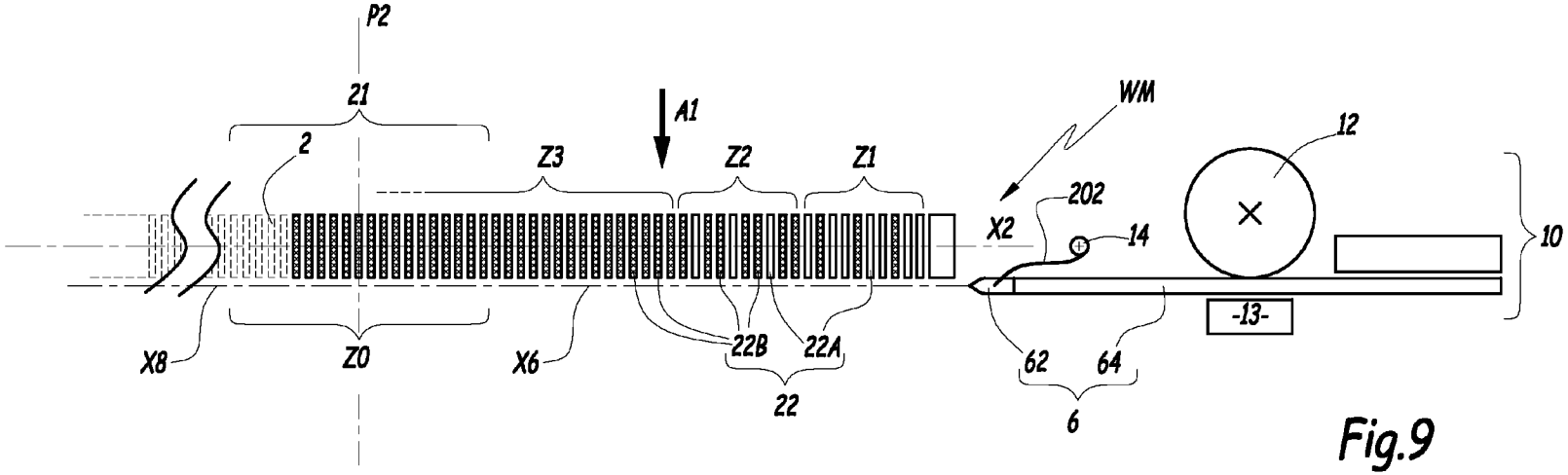
FIG. 9 is a top view similar to FIG. 1 for a weaving machine incorporating a weft insertion system and a reed according to a fourth embodiment of the invention.
Figure 7:
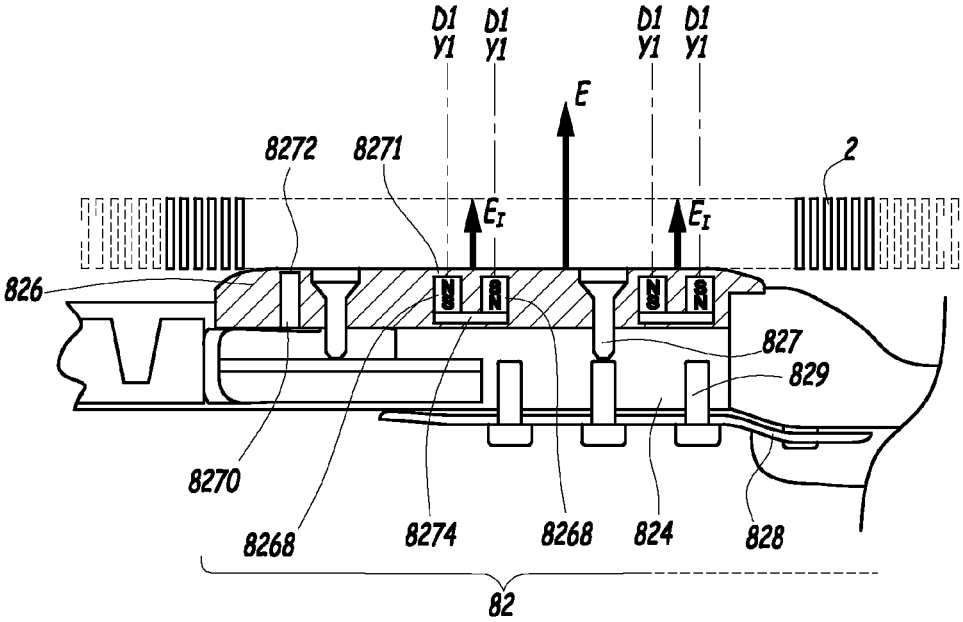
FIG. 7 is a partial cut view similar to FIG. 6 for a rapier and a system according to a second embodiment of the invention.
Figure 8:
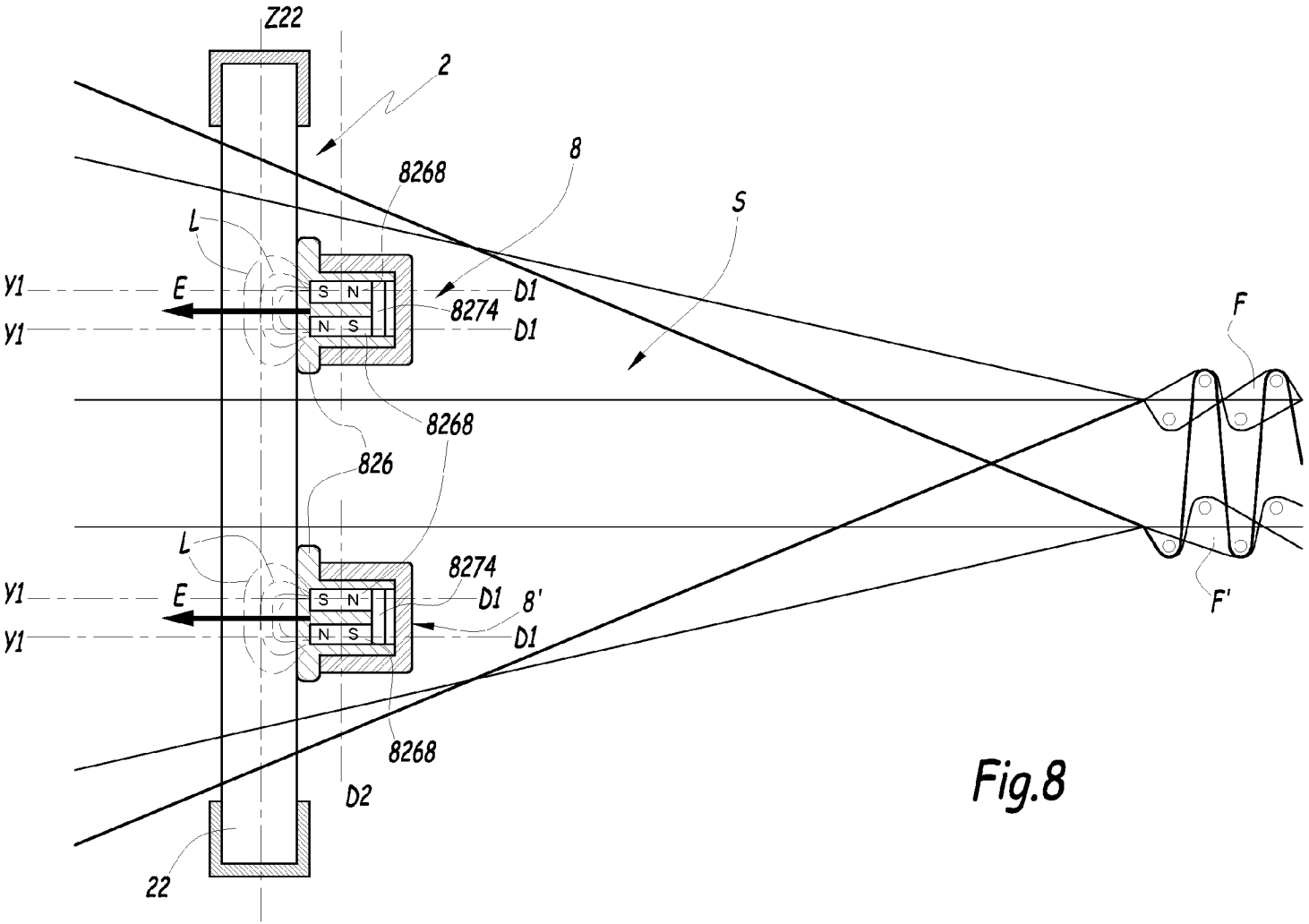
FIG. 8 is a sectional view similar to FIG. 3 for a system and rapiers corresponding to a third embodiment of the invention.

In the second to fourth embodiments of the invention represented on FIGS. 7 to 9, the same elements as in the first embodiment have the same references. Unless otherwise specified, these embodiments have a structure and work as in the first embodiment. Here-after, mainly the differences with the first embodiment are described in detail.

In the second embodiment of FIG. 7, magnets 8268 are magnetically coupled two by two, by a back plate 8274 made of a magnetic material, such as ARMCO iron. The respective directions of polarizations D1 of two adjacent permanent magnets 8268 are parallel, as in the first embodiment, but their polarities are inverted. In other words, the North pole N of one magnet and the South pole S of the other magnet of a pair of magnets associated with a back plate 8274 are oriented towards this back plate. The sub assembly formed of two magnets 8268 and one back plate 8274 constitutes a U magnet and provides a higher individual attractive magnetic effort $E_1$ than in the first embodiment. The respective magnetic efforts $E_1$ combine to form a global attractive effort E between rapier head 82 and reed 2, as in the first embodiment.

In the third embodiment of FIG. 8, the invention is used on a double fabric loom where two fabrics F and F' are woven together and simultaneously. A double shed S is formed and two sets of rapiers, represented here via their taker rapiers 8 and 8', slide along a reed 2 whose dents 22 extend respectively along a longitudinal axis Z22, which is vertical or globally vertical when the reed is in the back position represented on FIG. 8. In this embodiment, the magnets 8268 are also grouped by pairs and with a back plate 8274, which also forms U magnets, as in the second embodiment. The two magnets of one U magnet assembly are offset in a direction D2 which is parallel to axis Z22 in the configuration of FIG. 8. Irrespective of the position of reed 2, direction D2 is parallel to dents 22.

Under such circumstances, the magnetic lines L generated by the two permanent magnets 8268 of one U magnet close mainly into one dent 22, which is opposite these two permanent magnets, so that these lines only have two cross a thin portion of glider 826, which is made of a non magnetic material. The attractive magnetic effort E obtained in this way is improved with respect to the other embodiments.

This construction of U magnets can also be used for a single fabric loom and the constructions of the other embodiments can also be used with carpet looms.

In the embodiment of FIG. 9, the variation of the permeability of reed 2 along its longitudinal axis X2 is obtained by different repartitions of first type dents 22A and second type dents 22B along this axis.

In a first zone Z1, one dent 22 out of three is a second type dent 22B, and the other two dents are first type dents 22A. In a second zone Z2, one dent 22 out of three is a first type dent 22A and the other two dents are second type dents 22B. In a third zone Z3, all dents are of the second type 22B. Thus, the magnetic permeability of reed 2 increases from its extremity 24 towards its centre zone 21, which is aligned with take-over zone ZO where weft yarn 202 passes from bringer rapier 6 to the corresponding taker rapier 8, that is where rapier heads 62 and 82 must be precisely aligned.

The variability of the magnetic permeability of reed 2 is an advantageous aspect of the invention. However, this is not compulsory and the invention also works with a reed 2 having only one type of magnetic dents 22, with a single magnetic permeability.

As mentioned here-above, the magnetic means, that is the magnets 8268, are located in a connection zone between rapier head 82 and rod 84. More precisely, along axis X8, magnets 8268 are located between clamping means 822 and rack 845. This is also the case in rapier head 62 where the magnets are located, along axis X6, between clamping means 622 and rod 64. This implies that the attractive force E or E' exerted between rapier head 62 or 82 and reed 2 does not apply on the clamping means 622 and 822 which are not disturbed by this magnetic effort. Actually, the attractive magnetic effort E or E' is efficient to guide a rapier head 62 or 82 along reed 2, irrespective of the position of the other rapier head. Thus, one does not need to have both rapier heads in contact or almost in contact, as in EP-A-1 479 808, in order to obtain a guiding effect of the rapier heads.

The invention is described here-above in case heads 62 and 82 of rapiers 6 and 8 are provided with magnetic means. According to a non represented embodiment, only one of the rapiers, bringer rapier 6 or taker rapier 8, is provided with such magnetic means.

The invention also applies to a weft insertion system which only includes one rapier. A taker rapier is located on one side of the fabric and associated with a weft yarn presentation unit which is located on the opposite side of the fabric. Thanks to the attractive magnetic effort, the taker rapier follows a stabilized path through the shed and can accurately clamp the weft yarn.

Alternatively, a bringer rapier is located on one side of the fabric together with a weft yarn presentation unit and brings the weft yarn from one side to the other. Thanks to the attractive magnetic effort, the bringer rapier is prevented from shaking inside the shed and causing the weft yarn and/or its clamping means to rub against the warp yarns.

The polarization of the magnets 8268 can be inverted with respect to the configuration represented on the figures.

Alternatively, the magnetic means can be different from permanent magnets, namely electro-magnetic system with solenoids.

The embodiments and variants considered here-above can be combined in order to generate new embodiments of the invention.

The invention claimed is:

1. A weft insertion system for a weaving machine, said system including at least one rapier provided with weft yarn clamping means for drawing a weft yarn, wherein: the weft insertion system also includes a reed provided with dents made of a magnetic material, magnetic means are mounted on the rapier for exerting an attractive magnetic effort between the rapier and the dents of the reed; wherein the at least one rapier includes a rapier head which includes the weft yarn clamping means and a driving member for driving the rapier head in translation and wherein the magnetic means are located in a connection zone between the rapier head and the driving member; wherein the magnetic means include at least one permanent magnet whose direction of polarization extends along a direction which is substantially perpendicular to a longitudinal axis of the reed dents when the reed is in a back position and to a translation direction of the rapier; and wherein the at least one rapier is provided with a glider which glides on the dents of the reed during a back and forth motion of the rapier and wherein the magnetic means are fitted within the glider.

2. The weft insertion system according to claim 1, wherein the glider is provided with wear indication means for protecting the magnetic means from abrasion by contact with the dents of the reed.

3. The weft insertion system according to claim 1, wherein the at least one rapier is provided with a glider which glides on the dents of the reed during a back and forth motion of the rapier, wherein the magnetic means are fitted within the glider and wherein each permanent magnet is received within a blind hole arranged within the glider with an opening oriented opposite to a gliding surface of the glider, which glides on the dents of the reed during a back and forth motion of the rapier.

4. The weft insertion system according to claim 1, wherein the magnetic means include a plurality of permanent magnets with parallel directions of polarization and wherein the respective polarities of the permanent magnets are oriented in the same direction.

5. The weft insertion system according to claim 1, wherein the magnetic means include a plurality of permanent magnets with parallel directions of polarization and wherein at least two permanent magnets are coupled via a magnetic plate, with the respective polarities of the at least two permanent magnets oriented in opposite directions.

6. The weft insertion system according to claim 5, wherein at least two coupled permanent magnets are adjacent in a direction parallel to the reed dents.

7. The weft insertion system according to claim 1, including:

a bringer rapier provided with first weft yarn clamping means for drawing a weft yarn, a taker rapier provided with second weft yarn clamping means for taking up and drawing a weft yarn and wherein said bringer rapier and said taker rapier are provided with magnetic means for exerting magnetic effort between each rapier and the dents of the reed.

8. The weft insertion system according to claim 1 wherein the magnetic permeability of the reed varies along a longitudinal axis of the reed.

9. The weft insertion system according to claim 8, including first dents with a first magnetic permeability and second dents with a second magnetic permeability, the second magnetic permeability having a value higher than the first magnetic permeability.

10. The weft insertion system according to claim 7 wherein it includes first dents with a first magnetic permeability and second dents with a second magnetic permeability, the second magnetic permeability having a value higher than the first magnetic permeability, and wherein the reed is divided, along the longitudinal axis thereof, in at least two zones, with a first zone including the first dents and a second zone including the second dents and wherein the second zone includes a portion of the reed located opposite the weft yarn clamping means of the rapiers when the taker rapier takes the weft yarn from the bringer rapier.

11. A weaving machine comprising a weft insertion system according to claim 1.

* * * * *